United States Patent [19]

Ritzi

[11] 4,298,311

[45] Nov. 3, 1981

[54] TWO-PHASE REACTION TURBINE

[75] Inventor: Emil W. Ritzi, Manhattan Beach, Calif.

[73] Assignee: Biphase Energy Systems, Santa Monica, Calif.

[21] Appl. No.: 113,113

[22] Filed: Jan. 17, 1980

[51] Int. Cl.[3] ..... F01D 1/18

[52] U.S. Cl. ..... 415/80; 415/168; 60/649

[58] Field of Search ..... 415/80, 81, 82, 168, 415/114, 202; 60/649; 416/97 R

[56] References Cited

U.S. PATENT DOCUMENTS

| | | | |
|---|---|---|---|
| 3,358,451 | 12/1967 | Feldman et al. | 60/649 |
| 3,785,128 | 1/1974 | Redemann | 415/168 |
| 3,879,949 | 4/1975 | Hays et al. | 416/197 R |
| 3,972,195 | 8/1976 | Hays et al. | 416/197 R |
| 4,141,219 | 2/1978 | Elliot | 60/649 |

*Primary Examiner*—Louis J. Casaregola
*Attorney, Agent, or Firm*—William W. Haefliger

[57] ABSTRACT

A reaction turbine includes (a) first nozzle means to receive heated fluid for expansion therein to form a two-phase discharge of gas and liquid, (b) a separator rotor having an axis and a rotating surface located in the path of said discharge for supporting a layer of separated liquid on said surface, (c) the rotor having reaction nozzle means to communicate with said layer to receive liquid therefrom for discharge in a direction or directions developing torque acting to rotate the rotor.

19 Claims, 4 Drawing Figures

TWO-PHASE REACTION TURBINE

BACKGROUND OF THE INVENTION

This invention relates generally to a new class of heat engines wherein the working fluid, as for example water and steam, is employed to produce work while the fluid exists in its two-phase regions, with vapor and liquid existing simultaneously for at least part of the work cycle, typically the nozzle expansion. More specifically, the invention is useful in those applications where relatively lower speeds and higher torques are required, as in prime movers to drive electrical generators or gas compressors, and engines for marine and land propulsion. Also, the achievable high efficiency makes the invention useful to improve the expansion processes of vapor/liquid refrigeration.

The present invention is related to existing two-phase engines as disclosed in U.S. Pat. Nos. 3,879,949 and 3,972,195. As described therein, a two-phase mixture is accelerated in a nozzle, and after exiting from the nozzle the mixture is directed toward a rotary separator, where the two phases (liquid and gas) are separated in a high gravity field established by the rotary separator. The latter is also rotated to produce torque output.

SUMMARY OF THE INVENTION

It is a major object of the invention to provide an economical heat engine of low capital cost due to very simple construction, efficient conversion of heat energy to useful power output, high reliability, and minimum maintenance requirements. Basically, the invention is embodied in a reaction turbine comprising:

(a) first nozzle means to receive heated fluid for expansion therein to form a two-phase discharge of gas and liquid, (b) a separator rotor having an axis and a rotating surface located in the path of said discharge for supporting a layer of separated liquid on said surface, (c) the rotor having reaction nozzle means to communicate with said layer to receive liquid therefrom for discharge in a direction or directions developing torque acting to rotate the rotor.

As indicated, and in contrast to the disclosures of the above patents, the present invention employs reaction jets associated with the separator rotor to substantially increase the torque output from that rotor.

The objective of simple construction is achieved by operating the rotating elements of the turbine with liquid. In contrast to turbines operating on gas or vapor, the mechanical construction utilizes fewer close tolerances and fewer numbers of parts, and the gas or vapor expansion takes place in a stationary nozzle or nozzles. Further, and in contrast to conventional gas turbines, the expanding two-phase mixture in the nozzle is of low vapor quality; that is, the mass fraction of vapor to liquid is typically 5 to 25%. As a result, the enthalpy change per unit mass of mixture across the nozzle is reduced to such a degree that a single stage turbine, for example, is able to handle the entire expansion head at moderate stress levels. By way of contrast, comparable conventional impulse gas or vapor turbines require multiple stages. The turbine itself may consist of a liquid turbine that may be combined with a rotary separator in the manner to be described.

The reaction turbine of the invention is suited for operation with one component in two phases, such as water/water vapor (steam), ammonia/ammonia vapor, proplyene/propylene vapor. Other versions of the invention operate with two components: a low vapor pressure fluid which remains liquid in the nozzle and turbine, and a high vapor pressure fluid which partially or totally vaporizes in the nozzle. The versatility in the choice of working fluids gives the turbine a wide range of applications as a heat engine. The heat engine may, for example, operate across moderate temperature differences characteristic of solar, geothermal or waste heat sources. The turbine is equally applicable to temperature differences including a low temperature, such as encountered in refrigeration systems.

The invention provides an efficient energy conversion device when operating on liquid which has been accelerated by expanding gas or vapor in a two-phase nozzle. The liquid and gas or vapor are separated on the rotary separator portion of the turbine, and energy remaining in the gas or vapor may also be recovered by the use of vanes or blades. In many cases the vapor is useful in ancillary processes, e.g., low pressure steam for heating, drying or desalination.

These and other objects and advantages of the invention, as well as the details of an illustrative embodiment, will be more fully understood from the following description and drawings, in which:

DRAWING DESCRIPTION

DETAILED DESCRIPTION

Figure 1:
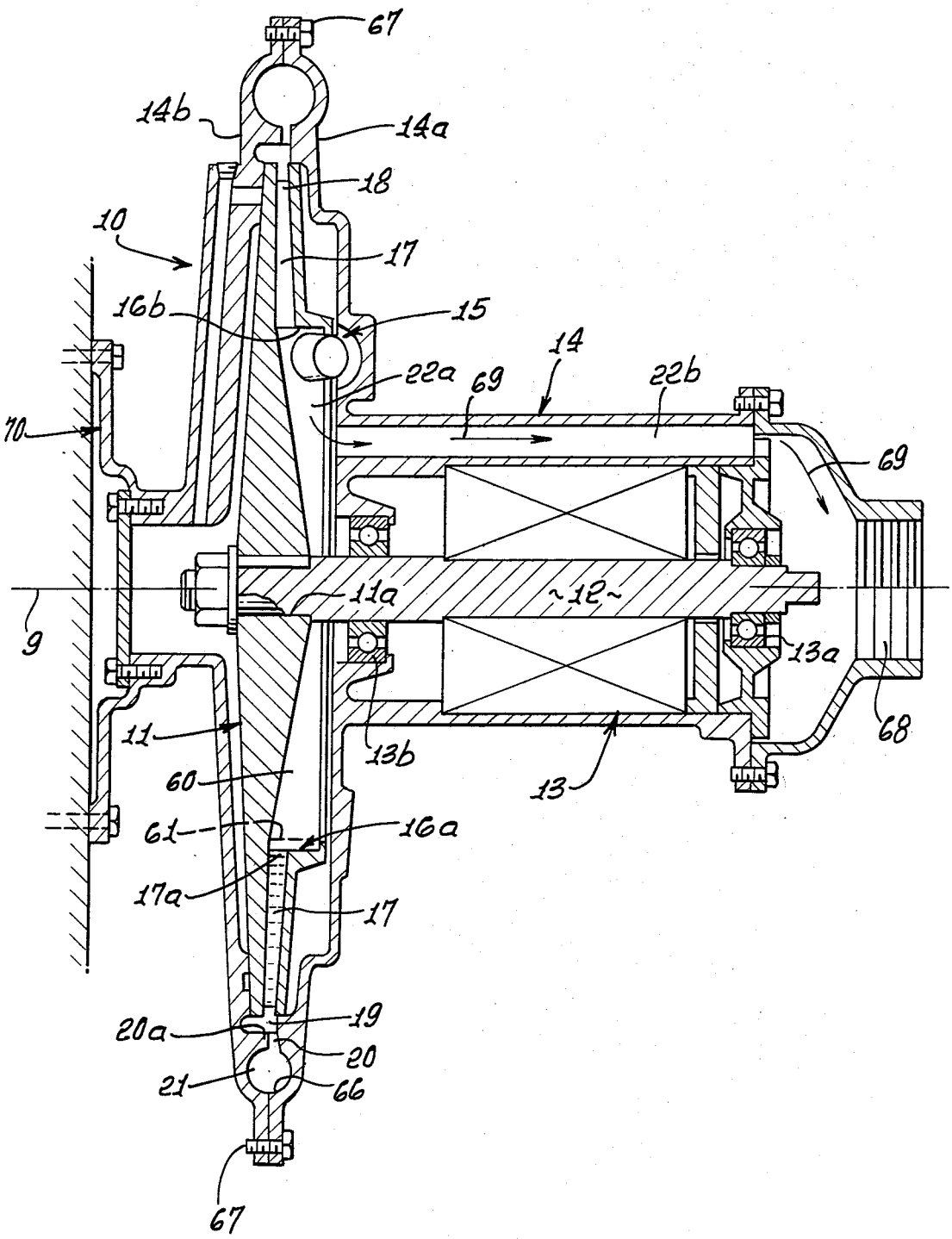
FIG. 1 is a vertical section through a two-phase reaction turbine.

Referring first to FIG. 1, the single stage two-phase reaction turbine 10 shown includes rotor 11 mounted at 11*a* on shaft 12. The shaft is supported by bearings 13*a* and 13*b*, which are in turn supported by housing 14. The two-phase nozzle 15, also carried by housing 14, is oriented to discharge the two-phase working fluid into the annular area 16*a* of rotary separator 11 wherein liquid and vapor are separated by virtue of the centrifugal force field of the rotating element 11. In this regard, the element 11 has an axis 9 and defines an annular, rotating rim or surface 16*b* located in the path of the nozzle discharge for supporting a layer of separated liquid on that surface. The separated gas or vapor collects in zone 60 spaced radially inwardly of inwardly facing shoulder or surface 16*b*. The nozzle itself may have a construction as described in U.S. Pat. Nos. 3,879,949 or 3,972,195. The surface of the layer of liquid at zone 16*a* is indicated by broken line 61, in FIG. 1. A source of the two-phase fluid fed to the nozzles is indicated at 65 in FIG. 2.

Figure 3:
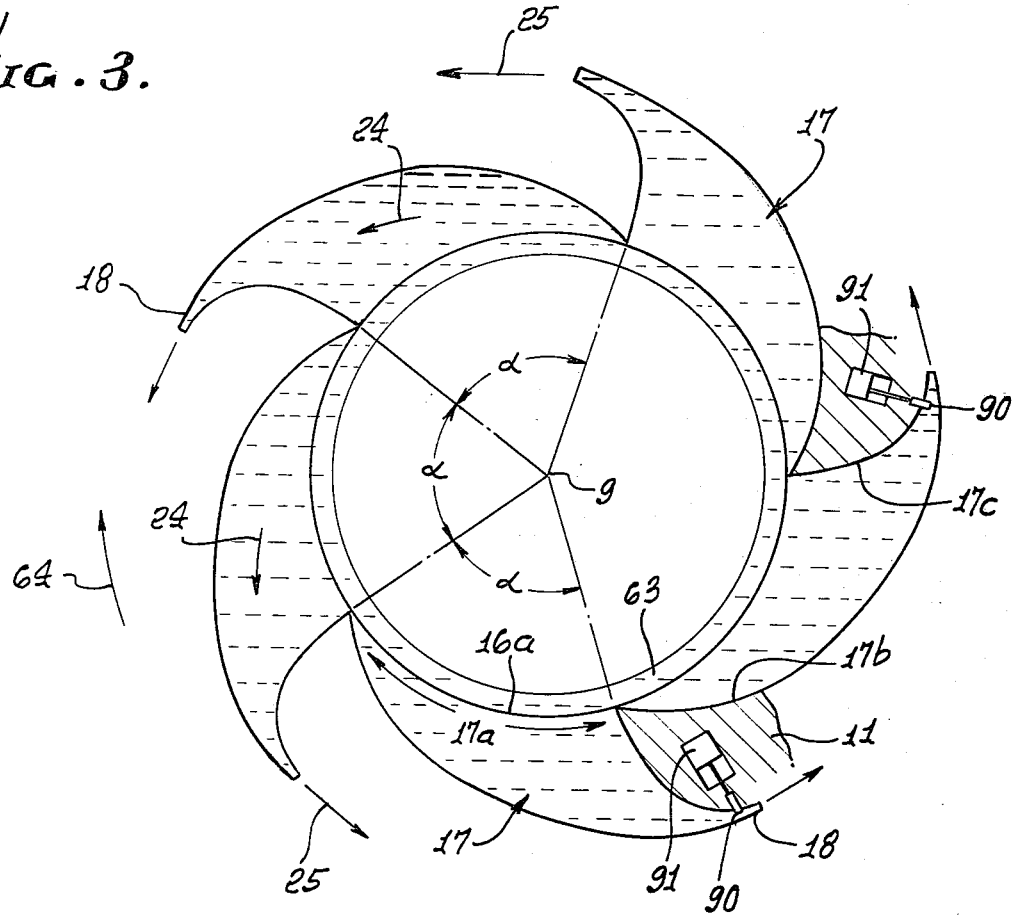
FIG. 3 is an axial schematic view of the rotor contour.

In accordance with the invention, the rotor 11 has reaction nozzle means located to communicate with the separated liquid collecting in area 16*a* to receive such liquid for discharge in a direction or directions to develop torque acting to rotate the rotor. More specifically, the rotor 11 may contain multiple passages 17 spaced about axis 9 to define enlarged entrances 17*a* communicating with the surface or rim 16*b* and the liquid separating thereon in a layer to receive liquid from that layer. FIG. 3 schematically shows such entrances 17*a* adjacent annular liquid layer 63 built up on rim or surface 16*a*. The illustrated entrances subtend equal angles $\alpha$ about axis 9, and five such entrances are shown, although more or less than five entrances may be provided. Arrow 64 shows the direction of rotation of the rotor, with the reaction nozzles 18 (one associated with each passage) angularly offset in a trailing direction from its associated passage entrance 17*a*. Passages 17 taper from their entrances 17*a* toward the nozzles 18 which extend generally tangentially (i.e. normal to radii extending from axis 9 to the nozzles). Note tapered walls 17*b* and 17*c* in FIG. 3, such walls also being curved.

The nozzles 18 constitute the reaction stage of the turbine. The liquid discharged by the nozzles is collected in annular collection channel 19 located directly inwardly of diffuser ring 20*a* defining diffuser passages 20. The latter communicate between passage 19 and liquid volute 21 formed between ring 20*a* and housing wall 66. The housing may include two sections 14*a* and 14*b* that are bolted together at 67, to enclose the wheel or rotor 11, and also form the diffuser ring, as is clear from FIG. 1. FIG. 1 also shows passages 22*a* and 22*b* formed by the housing or auxiliary structure to conduct vapor or gas to discharge duct 68, as indicated by vapor flow arrows 69. The vapor is conducted outwardly of and adjacent structure 13 which is coaxial with axis 9. Structure 13 may be mounted on shaft 12 for rotation therewith, and may for example comprise an electrical generator, or a pump, or a compressor. Mounting structure for the housing appears at 70.

Figure 2:
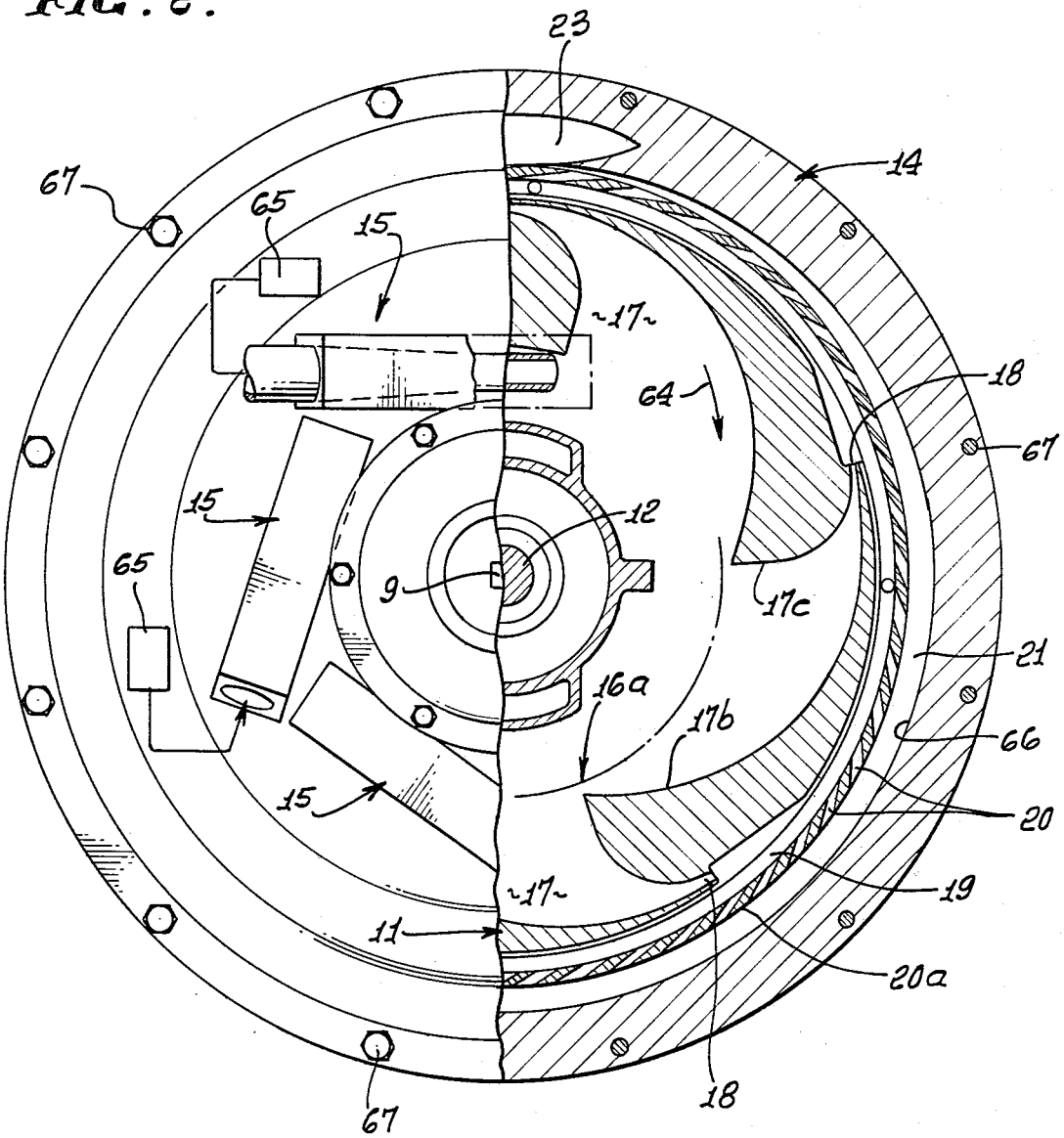
FIG. 2 is an axial view of the FIG. 1 apparatus.

The rotor passages 17 which provide pressure head to the reaction nozzles 18 are depicted in FIG. 2 as spaced about axis 9. Nozzles 15 are shown in relation to the rotary separator area 16*a*. It is clear that droplets of liquid issuing from the nozzles impinge on the rotary separator area 16*a*, where the droplets merge into the liquid surface and in so doing convert their kinetic energy to mechanical torque. The invention may employ one nozzle 15 or a multiplicity of nozzles, depending on desired capacity. The endwise shape or tapering of the liquid discharge volute 21 is easily seen in FIG. 2; liquid discharge from the machine takes place at the volute exit 23. In the case of brine feed to the nozzles, concentrated brine discharges at 23, and fresh water vapor at 69.

The flow path for the liquid in the rotor of the turbine is shown in FIG. 3 to further clarify the reaction principle. Liquid droplets from the nozzle impinge on the liquid surface 16*a*, and the liquid flows radially outward in the converging passages 17 to the liquid reaction nozzles 18. The reaction nozzles 18 are oriented in tangential directions adding torque to the rotating element. Liquid flow within each passage 17 is in the direction of the arrow 24. Jets of liquid issuing from the reaction nozzles 18 are in the tangential directions shown by the arrows 25.

Figure 4:
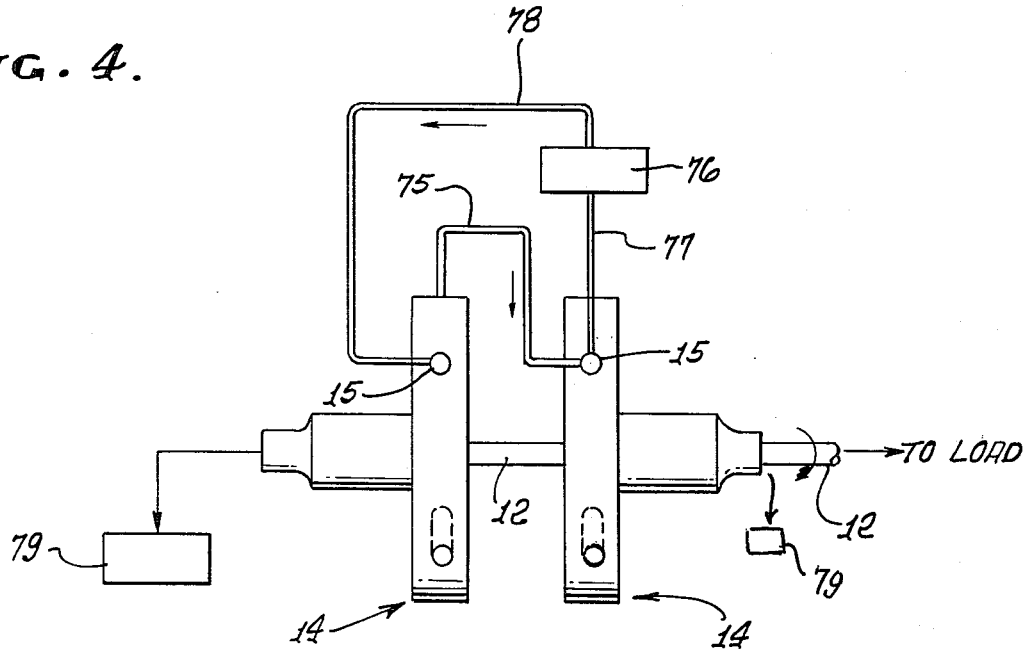
FIG. 4 is a schematic showing of multiple turbines.

In the schematic of FIG. 4 showing two structures as in FIGS. 1 and 2, the associated separators in housings 14 are mounted on the same shaft 12, and nozzles 15 are associated with each separator rotor. Ducting 75 supplies liquid discharged from one turbine volute to the nozzle 15 of the second turbine, and a source 76 of additional hot fluid is supplied at 77 to the nozzle 15 of the second turbine to mix with the liquid to provide a hot two-phase fluid for expansion in the nozzle 15. The heated fluid 76 typically consists of a low vapor pressure fluid component which remains liquid, and a high vapor pressure fluid which at least partially vaporizes in the nozzle means, and the source 76 may be connected to the nozzles of the first turbine, as indicated by duct 78. Condensers 79 are provided for condensing the vapor (such as fresh water) discharging from the turbines.

FIG. 3 also shows the provision of one form of means for selectively closing off liquid flow from the nozzles to vary the power output from the rotor. As schematically shown, such means includes gates or plugs 90 movable by drivers 91 into different positions in the passages 17 to variably restrict flow therein.

I claim:

1. In a reaction turbine, the combination comprising (a) first nozzle means to receive heated fluid for expansion therein to form a two-phase discharge of gas and liquid, (b) a separator rotor having an axis and a rotating surface located in the path of said discharge for supporting a layer of separated liquid on said surface, (c) the rotor having reaction nozzle means to communicate with said layer to receive liquid therefrom for discharge in a direction or directions developing torque acting to rotate the rotor.

2. The combination of claim 1 wherein the rotor defines passage means communicating with said surface to receive liquid flowing from said layer, the passage means extending generally radially outwardly relative to said axis so that liquid in said passage means is pressurized by centrifugal force.

3. The combination of claim 2 wherein said reaction nozzle means includes multiple reaction nozzles directed generally tangentially relative to the paths of nozzle rotation.

4. The combination of claim 2 wherein said passage means includes multiple passages each terminating at one of said reaction nozzles, the passages tapering toward the nozzles.

5. The combination of claim 4 including means for selectively closing off liquid flow from the nozzles to vary the power output from the rotor.

6. The combination of claim 4 wherein each passage has an entrance subtending a circularly curved portion of said surface.

7. The combination of claim 6 wherein the reaction nozzle associated with each passage is angularly offset, about said axis, from said passage entrance.

8. The combination of claim 1 including a second turbine rotor as defined in (b) and (c) of claim 1, and additional nozzle means to receive heated fluid for expansion therein to form a two-phase gas and liquid discharge onto the rotating surface of the second rotor, the two rotors connected to rotate together.

9. The combination of claim 8 including ducting to supply liquid discharged from the first rotor to said additional nozzle means.

10. The combination of claim 9 including a source of additional hot fluid supplied to the additional nozzle means.

11. The combination of claim 1 wherein said heated fluid consists of a low vapor pressure fluid component which remains liquid, and a high vapor pressure fluid which at least partially vaporizes in said first nozzles means.

12. The combination of claim 1 including a diffuser ring at the periphery of said rotor, and having ports to diffuse outwardly the liquid discharge from said reaction nozzle means.

13. The combination of claim 12 including means forming a volute located to receive liquid diffusing outwardly via said diffuser ring.

14. The combination of claim 1 including structure operatively connected to the rotor to be driven thereby, for supplying useful power.

15. The combination of claim 14 wherein said structure includes an electrical generator.

16. The combination of claim 14 wherein said structure includes a pump.

17. The combination of claim 14 wherein said structure includes a compressor.

18. The combination of claim 1 including ducting to remove separated gas from the vicinity of the rotor.

19. The combination of claim 18 including condenser means to condense said gas.

* * * * *